US007474182B2

(12) United States Patent
Bolz et al.

(10) Patent No.: US 7,474,182 B2
(45) Date of Patent: Jan. 6, 2009

(54) CONTACTOR WITH CONNECTOR MODULE FOR CONTROL OF THE SOLENOID MECHANISM

(75) Inventors: Jakob Bolz, Bonn (DE); Wolfgang Kremers, Bonn (DE); Alfred Michael Wohlang, Bomheim (DE)

(73) Assignee: Moeller GmbH, Bonn (DE)

( * ) Notice: Subject to any disclaimer, the term of this patent is extended or adjusted under 35 U.S.C. 154(b) by 233 days.

(21) Appl. No.: 10/598,353

(22) PCT Filed: Feb. 25, 2005

(86) PCT No.: PCT/EP2005/050810

§ 371 (c)(1),
(2), (4) Date: Aug. 24, 2006

(87) PCT Pub. No.: WO2005/083733

PCT Pub. Date: Sep. 9, 2005

(65) Prior Publication Data

US 2008/0174391 A1 Jul. 24, 2008

(30) Foreign Application Priority Data

Feb. 27, 2004 (DE) ..... 10 2004 009 650

(51) Int. Cl.
*H01H 67/02* (2006.01)

(52) U.S. Cl. ..... 335/131; 335/132; 335/202

(58) Field of Classification Search ..... 335/131–132, 335/202

See application file for complete search history.

(56) References Cited

U.S. PATENT DOCUMENTS

| | | | | |
|---|---|---|---|---|
| 4,992,765 | A * | 2/1991 | Hirota et al. | 335/131 |
| 5,684,442 | A * | 11/1997 | Hufschmid | 335/132 |
| 6,297,718 | B1 * | 10/2001 | Scholz et al. | 335/202 |
| 6,411,184 | B1 | 6/2002 | Comtois et al. | |
| 6,452,468 | B1 * | 9/2002 | Jacq et al. | 335/132 |

FOREIGN PATENT DOCUMENTS

| | | |
|---|---|---|
| DE | 4236890 | 5/1994 |
| DE | 29610329 | 8/1996 |
| DE | 19814432 | 12/1999 |
| DE | 19939020 | 3/2000 |
| DE | 10013353 | 10/2001 |

OTHER PUBLICATIONS

Moeller GmbH: "Industrie-Schaltgeräte", Hauptkatalog 2002 (6 pages) and English language version thereof entitled "Industrial Switchgear", Main Catalog 2002, Moeller GmbH (6 pages).

* cited by examiner

*Primary Examiner*—Ramon M Barrera
(74) *Attorney, Agent, or Firm*—Darby & Darby

(57) ABSTRACT

A contactor includes a housing lower section housing a solenoid mechanism, a main contact and a housing upper section, for housing main terminals and a connector module including control terminals which may be connected to the solenoid coil of the solenoid mechanism. The housing upper section includes a recessed step to the front of a housing side, in which the connector module may be fixed. The control terminals are located facing the housing front in front of the plane of the main terminals. Connector lines extending into the main housing from the connector module connect the control terminals to the control pins, connected to the solenoid coil and located in the housing lower section.

9 Claims, 5 Drawing Sheets

CONTACTOR WITH CONNECTOR MODULE FOR CONTROL OF THE SOLENOID MECHANISM

CROSS REFERENCE TO PRIOR APPLICATIONS

This application is a U.S. National Phase of International Patent Application No. PCT/EP2005/050810, filed Feb. 25, 2005, which claims priority to German Patent Application No. DE 10 2004 009 650, filed Feb. 27, 2004, the entire disclosure of which is incorporated by reference herein. The International Application was published in German on Sep. 9, 2005 as WO 2005/08733.

FIELD OF THE INVENTION

The present invention relates to an electromagnetic contactor having a main housing and a connection module.

BACKGROUND

German Publication DE 199 39 020 A1 describes a contactor including a lower housing part and an upper housing part, which are each molded of insulating material. Arranged in the lower housing part are a fixed magnet yoke, an armature capable of moving relative to said magnet yoke, and a solenoid coil wrapped around the magnet yoke. The upper housing part accommodates main contacts, which are composed of contact bridges linked to the armature and of fixed contacts capable of being brought into and out of contact with said contact bridges, the upper housing part further accommodating main terminals conductively connected to the fixed contacts, as well as control terminals conductively connected to the coil ends. Viewed in the direction of the housing front, the control terminals are located in a plane behind the plane of the main terminals. When wiring contactors, usually the thick inflexible main current leads are connected to the main terminals first, and then the much thinner control leads are connected to the control terminals. It is a disadvantage that the control terminals are ergonomically difficult to access because of the covering main current leads.

Contactors of this type are shown in both document DE 198 14 432 C1 and the "Industrial Switchgear" main catalog 2002 of the firm Moeller GmbH, p. 06/006,020 f. These contactors have a lower housing part accommodating an electromagnetic operating mechanism, and an upper housing part accommodating main contacts and main terminals. Connection modules having control terminals A1, A2 or A3, A4 or A10, A11 allowing different options for controlling the electromagnetic operating mechanism, as well as a dummy module can be mounted at the corner edges of the lower housing part. The control terminal sides of the connection modules, which are defined by the control terminal openings to the control terminals, extend parallel to the main terminal sides of the upper housing part, which are defined by the main terminal openings to the main terminals. Tool access to the control terminals is perpendicular to the housing front through operating openings. Here too, the connection of control leads is hampered by the previously connected main current leads extending in front of the control terminals.

Document DE 296 10 329 U1 describes a plug-in connection module for electrical connection to two mating terminals which are connected inside the housing to the solenoid coil of an electromagnetic operating mechanism. Viewed in the direction of the housing front, the mating terminals, which are open toward the housing front, are located in front of the plane of main terminals, whose main terminal openings are formed in the housing sides extending perpendicular to the housing front.

SUMMARY OF THE INVENTION

It is an object of the present invention to facilitate connection of the control leads when the main current leads are already connected.

The present invention provides a contactor comprising: a main housing including a lower housing part and an upper housing part; the lower housing part at least partially accommodating an electromagnetic operating mechanism, and the upper housing part accommodating main contacts and main terminals; and a connection module which contains control terminals connectable to the solenoid coil of the electromagnetic operating mechanism, and whose control terminal sides, which are defined by the control terminal openings to the control terminals, extend parallel to the main terminal sides of the upper housing part, which are defined by the main terminal openings to the main terminals, said connection module further having operating openings to the control terminals, said operating openings being able to be accessed by tools in a direction perpendicular to the housing front, wherein on a housing side extending perpendicular to both the housing front and the main terminal sides, the upper housing part is set back, forming a step recess, the connection module is capable of being mounted on upper housing part, in which condition the connection module at least partially fills the step recess, and the control terminals are located in front of the plane of the main terminals, as viewed in the direction of the housing front, connecting conductors protruding from the connection module into main housing connect the control terminals to control sockets which are located in the lower housing part and connected to the solenoid coil.

The connection module is configured and arranged on the upper housing part in such a way that the control terminals are located in front of the main terminals, as viewed in the direction of the housing front. This allows the control leads to be connected without being hampered in a time-consuming and costly manner by main current leads that are already connected. The control terminals are electrically connected via connecting conductors to internal control sockets, which in turn are connected to the coil terminals. This allows connection modules of the same size to be most widely used for contactors of different size.

In a preferred refinement of the present invention, the connection module has a front cover element and a rear base element. The operating openings, which lead to the control terminals and are provided for entry of a tool, are formed in the cover element. The connecting conductors protrude from the base element at the rear, and into the main housing. When joining the cover element to the base element, preferably by snap-fit connections, the control terminals inserted therebetween are secured in position. The connection module is mounted and secured in position on the upper housing part. Lateral openings conveniently left between the cover element and the base element are used as control terminal openings.

On the one hand, especially in the case of smaller contactors, it is convenient for the control terminals to be integrally formed in one piece with the bar-shaped connecting conductors. On the other hand, especially in the case of larger contactors, it is convenient for the control terminals to merge into jaw-like blade sockets for receiving the control-terminal side conductor ends of the bar-shaped connecting conductors.

One advantageous refinement provides for the control terminals to have extensions extending therefrom toward the center of the connection module, said extensions being provided with socket-like openings into which an add-on module, such as a suppressor circuit, can be inserted via insertion openings formed in the cover element and connected to the solenoid coil.

BRIEF DESCRIPTION OF THE DRAWINGS

Further details and advantages of the present invention will become apparent from the exemplary embodiments described below with reference to the figures, in which.

DETAILED DESCRIPTION

Figure 1:
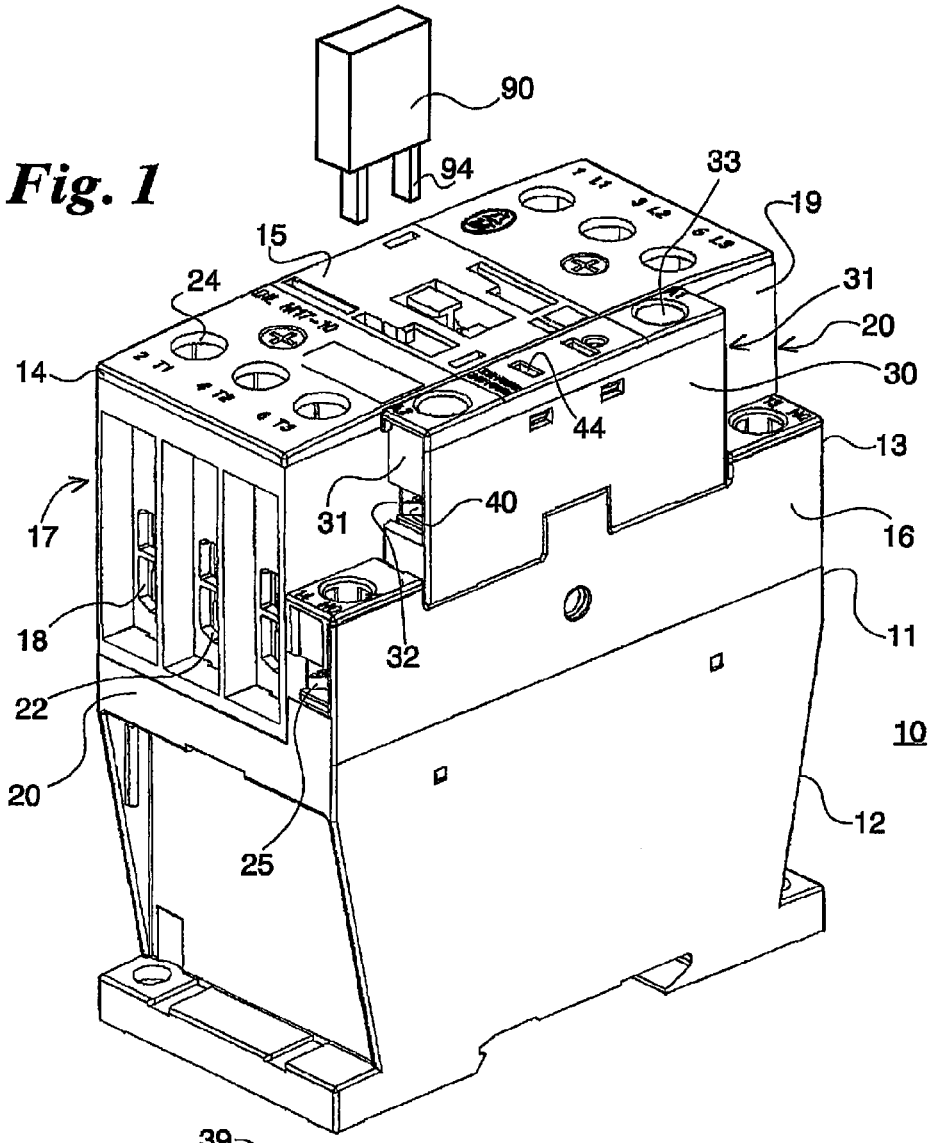
FIG. 1 shows a first embodiment of the contactor of the present invention in a fully assembled condition.
Figure 2:
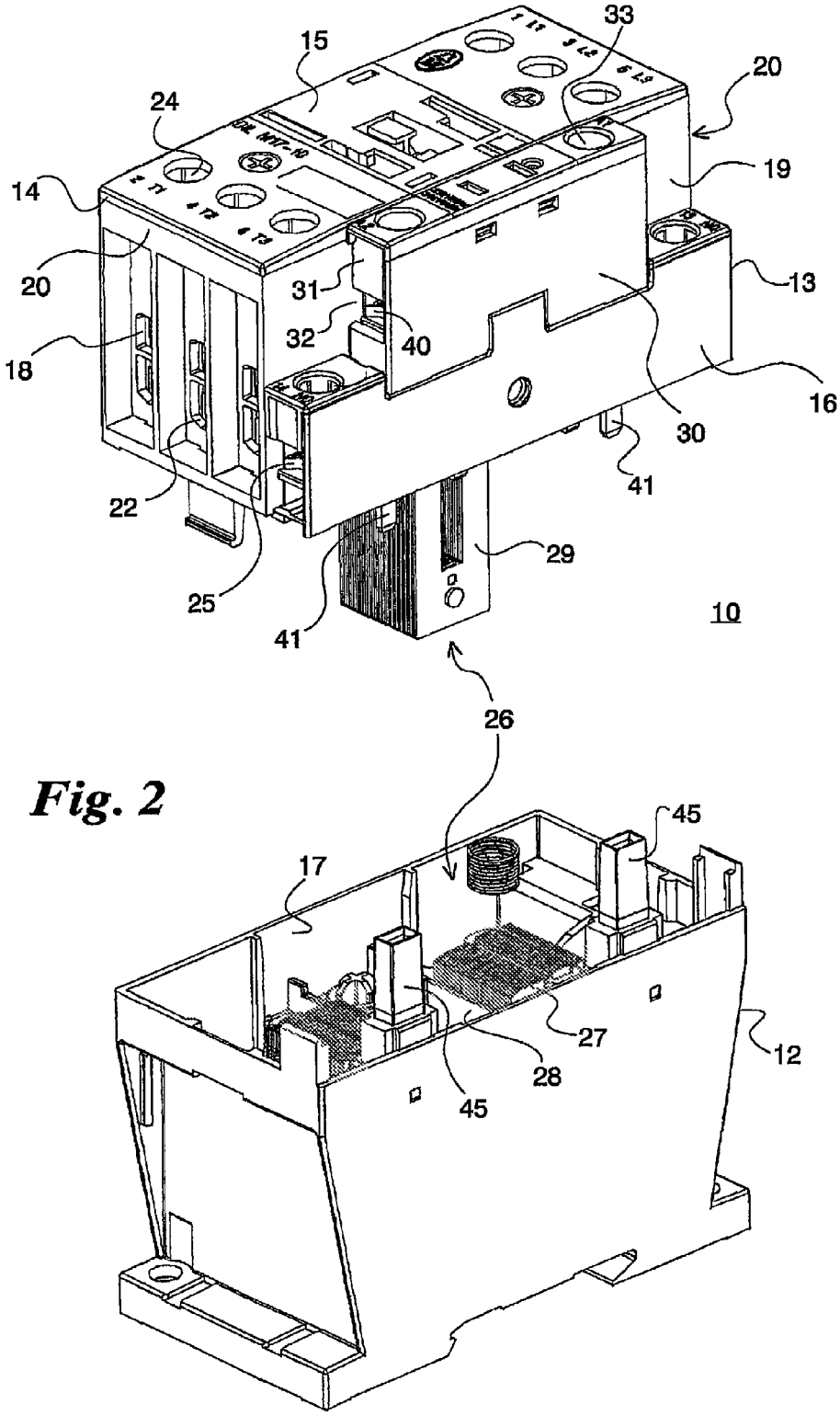
FIG. 2 shows the contactor of FIG. 1 in a partially assembled condition.

FIG. 1 and FIG. 2 show a three-pole contactor 10 rated for low and medium currents. Contactor 10 is enclosed by a main housing 11 including a lower housing part 12 and an upper housing part 13, which can be snap-fitted to said lower housing part. Upper housing part 13 is closed at housing front 15 by a housing cover 14. Contactor 2 has three main contacts, which are supported upper housing part 13. The main contacts include, for each pole, a pair of fixed contacts which are connectable by a movable contact bridge. The fixed contacts are connected to incoming and load-side main terminals 18, respectively. Main terminals 18 are accessible on the two opposite main terminal sides 20 through main terminal openings 22 for main current leads to be connected. Main terminals 18 can be operated by a screwdriver via front screw openings 24 provided in housing cover 14. Contactor 10 further includes an electromagnetic operating mechanism 26. Electromagnetic operating mechanism 26 includes a U-shaped magnet yoke 27 mounted in lower housing part 12, a solenoid coil 28 having two coil sections wrapped around the two outer legs of magnet yoke 27, as well as an armature 29 coupled to the contact bridges.

Upper housing part 13 has a housing side 16 which extends perpendicular to both the housing front 15 and the main terminal sides 20. Housing side 16 is set back toward the opposite housing side 17, forming a continuous step recess 19. Below step recess 19, there are provided auxiliary terminals 25 for an auxiliary contact located in upper housing part 13. Within step recess 19, a connection module 30 is mounted on upper housing part 13, in which condition it is flush with housing front 15 of main housing 11. As will be described in more detail below, connection module 30 is used to establish an electrical connection between solenoid coil 28 and control leads. To this end, connection module 30 is provided on opposite control terminal sides 31 with control terminal openings 32 through which to insert the control leads into control terminals 40. Control terminals 40 preferably take the form of screw terminals or cage clamp terminals. In order to allow operating control terminals 40 to be operated when connecting or disconnecting the control leads, connection module 30 is provided with front operating openings 33 for insertion of a tool. Viewed in the direction of housing front 15, control terminals 40 are located in front of main terminals 18. Due to this advantageous spatial arrangement, control terminal openings 32 are unobstructedly accessible for the control leads when, as is usual, the main current leads are already connected.

Figure 3:
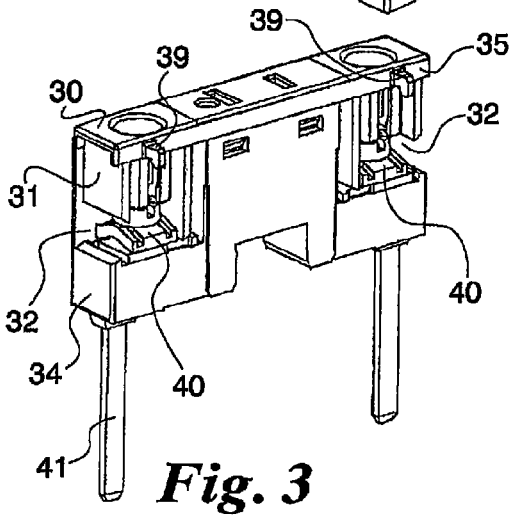
FIG. 3 and FIG. 4 are different views of the assembled connection module of FIG. 1.
Figure 4:
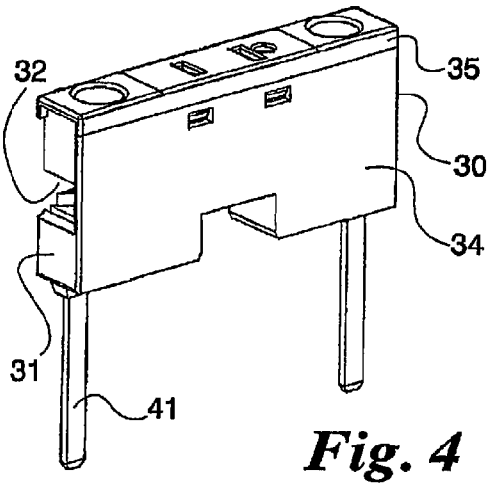
Figure 5:
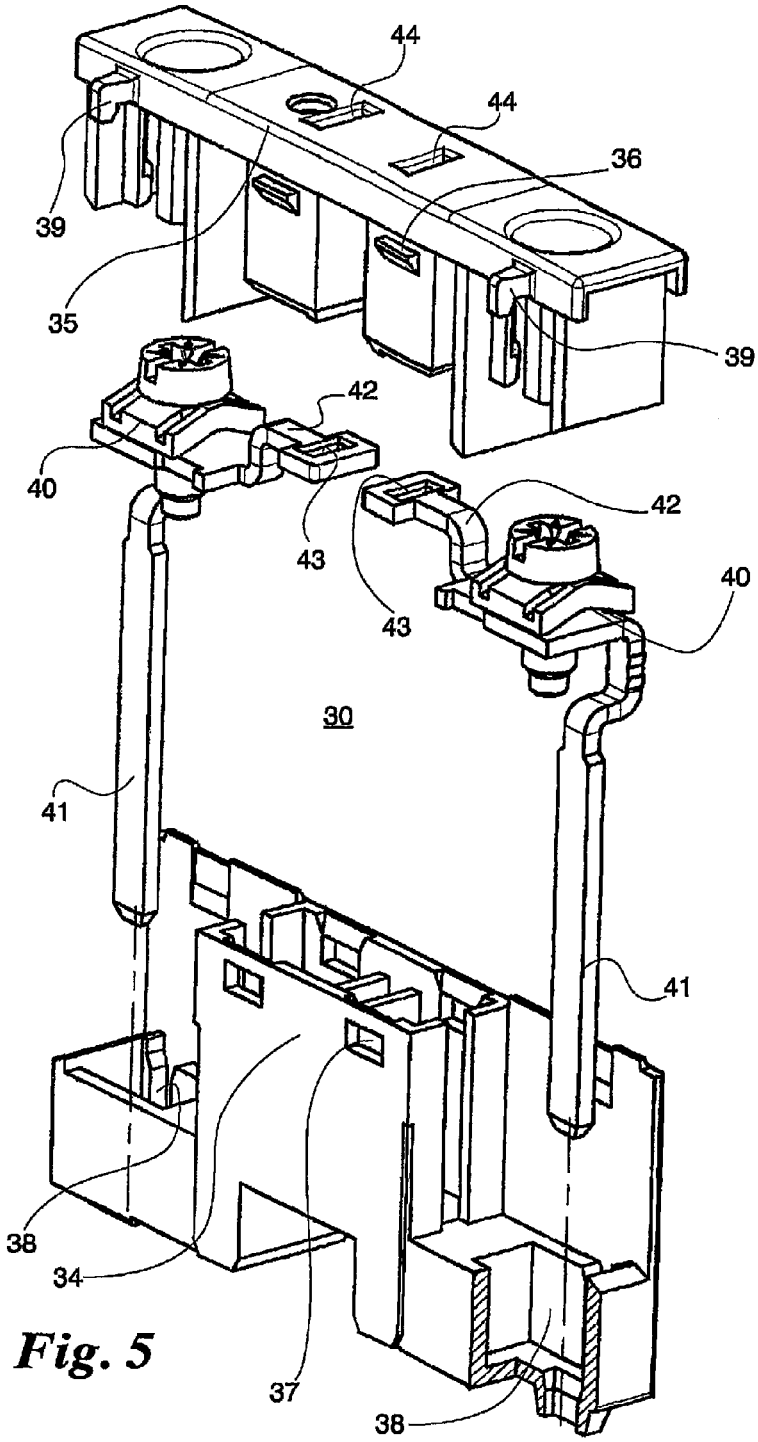
FIG. 5 is a pulled-apart, enlarged view of the connection module of FIG. 3 and FIG. 4.

In FIG. 3 through FIG. 5, connection module 30 is shown in detail. Connection module 30 includes a base element 34, a front cover element 35, and the two control terminals 40. Control terminals 40 are secured in position between base element 34 and cover element 35 when joining these elements. In the process, latching noses 36 of cover element 35 snap into latch openings 37 of base element 34. Control terminal openings 32 remain open between the snapped-together cover element 35 and base element 34. Each control terminal 40 integrally merges into a bar-shaped connecting conductor 41 in a direction facing away from cover element 35. The connecting conductors 41 protrude from base element 34 at the rear through openings 38. Each control terminal 40 integrally merges into a strip-shaped extension 42 in an inward direction toward the center of cover element 35. Extensions 42 widen at the ends, forming one slot-shaped socket-like opening 43 each. In the assembled condition of connection module 30, openings 43 are located within the imaginary extension of slot-shaped insertion openings 44 formed in cover element 35 on the front. Two mounting hooks 39 project from cover element 35 and engage with corresponding receptacles of upper housing part 13.

According to FIG. 2, two control sockets 45 are mounted in lower housing part 12, said control sockets being conductively connected to the coil ends of solenoid coil 28. When placing connection module 30 onto upper housing part 13 of the assembled main housing 11, each of the connecting conductors 41 extends, with its free end, into one of the control sockets 45, respectively. In this manner, conductive connections are established between control terminals 40 and solenoid coil 28.

FIG. 1 indicates that an add-on module 90 may be mounted on connection module 30. Add-on module 90 has two connector pins 94 at the rear. When mounting add-on module 90, connector pins 94 extend through insertion openings 44 and contact socket-like openings 43 inside the connection module 30. In this manner, add-on module 90 is conductively connected to solenoid coil 28. Add-on module 90 preferably accommodates a suppressor circuit for solenoid coil 28.

Figure 6:
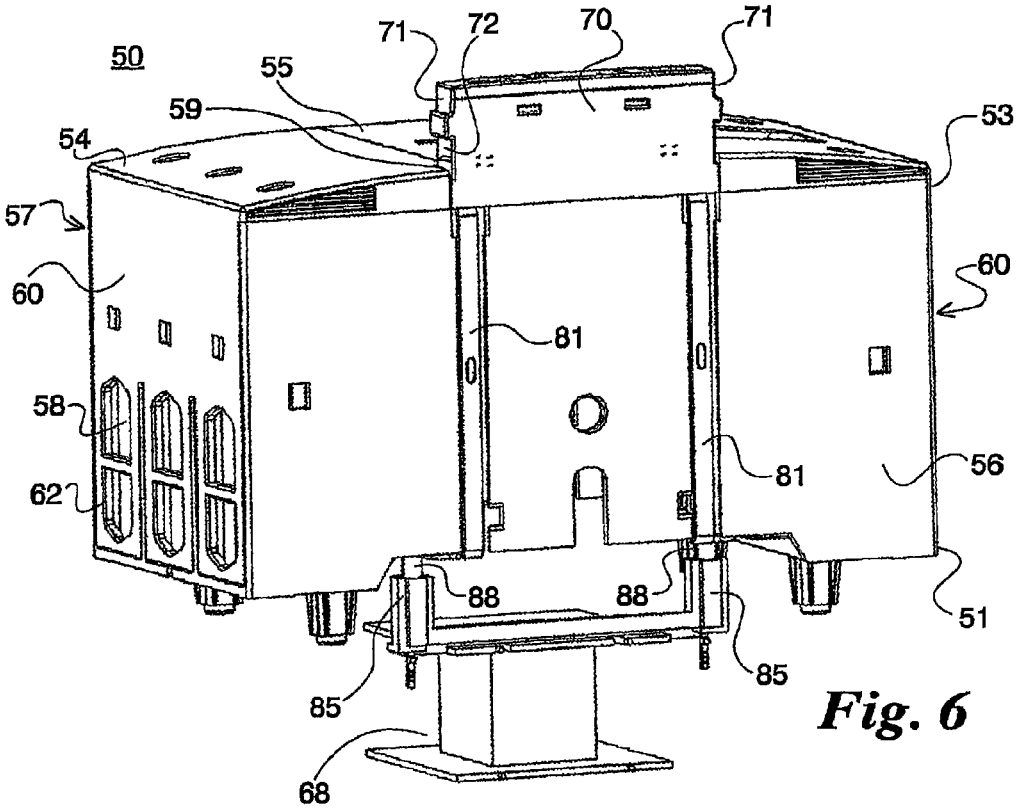
FIG. 6 is a partial view of a second embodiment of the contactor of the present invention.

FIG. 6 shows a three-pole contactor 50 which is rated for medium and higher currents and has a main housing 51 including a lower housing part (not shown) and an upper housing part 53 which can be closed by a housing cover 54 at housing front 55. Main terminals 58 are accessible on the two opposite main terminal sides 60 through main terminal openings 62. Contactor 50 further contains an electromagnetic operating mechanism, of which only solenoid coil 68 is shown, said solenoid coil being indicated by its coil form.

Upper housing part 53 has a housing side 56 which extends perpendicular to both the housing front 55 and the main terminal sides 60. The central portion of housing side 56, which extends vertically in FIG. 6, has been graphically removed in order to render visible some of the insides of contactor 50. Housing side 56 is set back toward the opposite housing side 57, forming a step recess 59 which is bounded on both sides. Within step recess 59, a connection module 70 is mounted on upper housing part 53, in which condition it projects above housing front 55. According to FIG. 6 and FIG. 7, connection module 70 is provided on opposite control terminal sides 71 with control terminal openings 72 through which to insert the control leads into control terminals 80. Control terminals 80 preferably take the form of screw terminals or cage clamp terminals. In order to allow operating control terminals 80 to be operated when connecting or disconnecting the control leads, connection module 70 is provided with front operating openings 73. Viewed in the direction of housing front 55, control terminals 80 are located in front of main terminals 58. Due to this advantageous spatial arrangement, control terminal openings 72 are unobstructedly accessible for the control leads when, as is usual, the main current leads are already connected.

Figure 7:
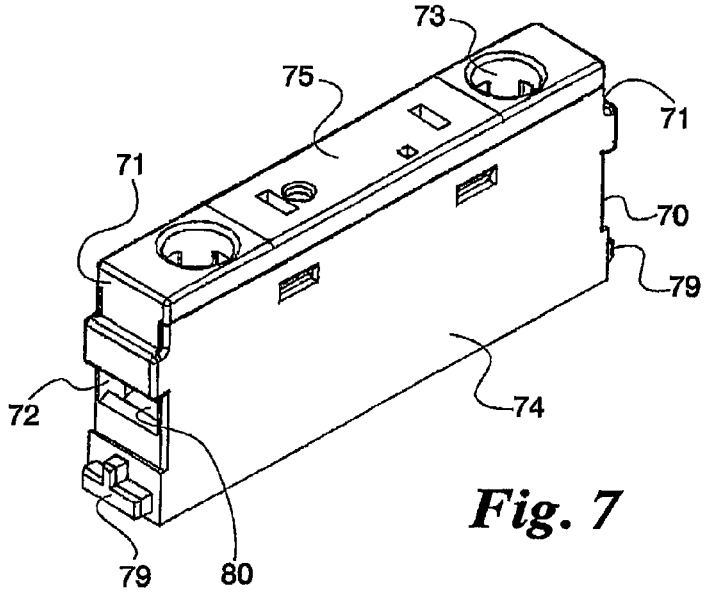
FIG. 7 is an assembled view of the connection module of FIG. 6.
Figure 9:
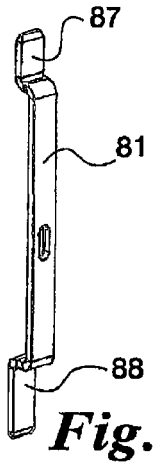
FIG. 9 is a separate view of a connecting conductor from FIG. 6.
Figure 8:
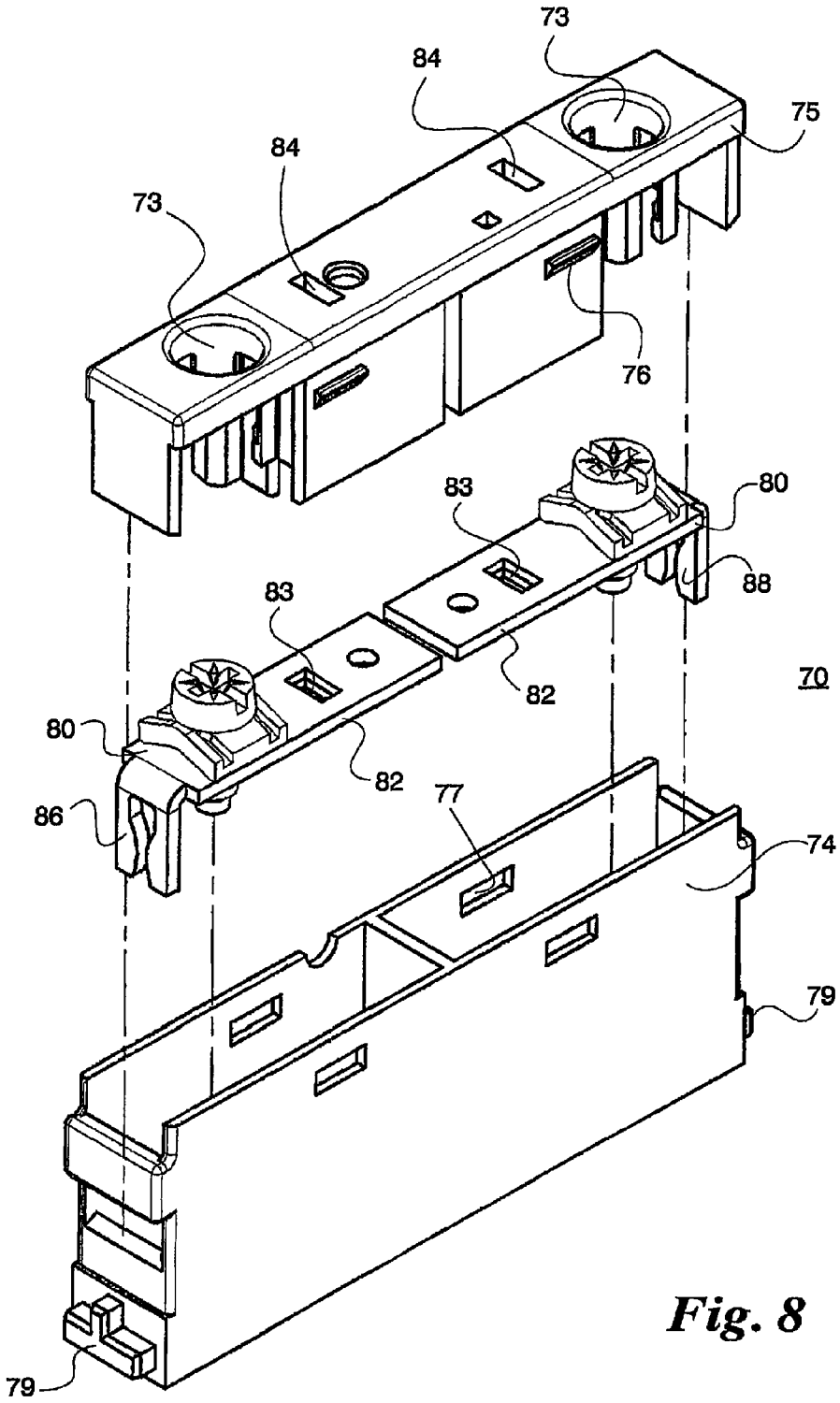
FIG. 8 is a pulled-apart, enlarged view of the connection module of FIG. 7.

In FIG. 7 through FIG. 9, connection module 70 is shown in detail. Connection module 70 includes a base element 74, a front cover element 75, and the two control terminals 80. Control terminals 80 are secured in position between base element 74 and cover element 75 when joining these elements. In the process, latching noses 76 of cover element 75 snap into latch openings 77 of base element 74. Control terminal openings 72 remain open between the snapped-together cover element 75 and base element 74. Each control terminal 80 integrally merges into a jaw-like blade socket 86 in a direction facing away from cover element 75. Inside cover element 75, each control terminal 80 integrally merges into a strip-shaped extension 82 in an inward direction. Extensions 82 are each provided with a slot-shaped socket-like opening 83. In the assembled condition of connection module 70, openings 83 are located within the imaginary extension of slot-shaped insertion openings 84 formed in cover element 75 on the front. A mounting hook 79 is formed on each control terminal side 71 of base element 74. The connection module 70 inserted in step recess 59 is locked in place by mounting hooks 79 when upper housing part 53 is subsequently closed by housing cover 54.

Also provided are two bar-shaped connecting conductors 81, which are double-angled in opposite directions at their two conductor ends 87 and 88. The coil form of solenoid coil 68 has two control sockets 85 which are conductively connected to the coil ends. When connection module 70 is connected to upper housing part 73 of the assembled main housing, each of the connecting conductors 81 contacts one of the control sockets 85 with its coil-side conductor end 87, and one of the blade sockets 86 with its control-terminal side conductor end 87, respectively; the connecting conductors 81 entering the base element 74 at the rear, and the blade sockets being adapted to have sufficient inherent resilience. In this manner, conductive connections are established between control terminals 80 and solenoid coil 68. By suitably adapting the geometry of connecting conductors 81, it is possible for connection module 70 to be mounted on contactors of different sizes. Having insertion openings 84 and socket-like openings 83, connection module 70 is also suitable to receive an add-on module 90 shown in FIG. 1.

The invention claimed is:

1. A contactor comprising:

an electromagnetic operating mechanism having a solenoid coil;

a plurality of main contacts;

a plurality of main terminals;

a plurality of control terminals connectable to the solenoid coil;

a plurality of control sockets connected to the solenoid coil;

a main housing having a housing front and including a lower housing part at least partially accommodating the electromagnetic operating mechanism and the control sockets, and an upper housing part accommodating the main contacts and the main terminals, the upper housing part having main terminal sides defined by main terminal openings to the main terminals and a housing side extending perpendicular to the housing front and the main terminal sides, the upper housing part being set back on the housing side so as to form a step recess;

a connection module containing the control terminals and having control terminal openings defining respective control terminal sides of the control terminals, the control terminal sides extending parallel to the main terminal sides of the upper housing part, the connection module further having front operating openings to the control terminals configured to be accessed by tools in a direction perpendicular to the housing front, the connection module configured to mount on the upper housing part so as to at least partially fill the step recess and so that the control terminals are disposed in front of a plane of the main terminals as viewed in a direction of the housing front; and a plurality of connecting conductors protruding from the connection module into the main housing and connecting the control terminals to the control sockets.

2. The contactor as recited in claim 1, wherein the connection module has a cover element and a base element, the front operating openings being formed in the cover element, and the connecting conductors protruding from a rear of the base element, the base element and the cover element configured to be joined together so as to securing the control terminals disposed therebetween.

3. The contactor as recited in claim 2, wherein the cover element is configured to be snap-fitted to the base element.

4. The contactor as recited in claim 2, wherein the control terminal openings are disposed between the cover element and base element.

5. The contactor as recited in claim 1, wherein the control terminals are integrally formed in one piece with the connecting conductors.

6. The contactor as recited in claim 1, wherein the connecting conductors are bar-shaped.

7. The contactor as recited in claim 6, wherein each of the control terminals includes a jaw-like blade socket for receiving a control-terminal side conductor end of a respective bar-shaped connecting conductor.

8. The contactor as recited in claim 2, wherein the cover element includes a plurality of insertion openings and wherein each of the control terminals includes an extension portion having a socket-like opening disposed in alignment a respective insertion opening.

9. The contactor as recited in claim 8, wherein the insertion openings are configured to receive an add-on module.

* * * * *